US006058928A

United States Patent [19]

Sitko et al.

[11] Patent Number: 6,058,928

[45] Date of Patent: May 9, 2000

[54] LIQUID HEATING DEVICE

[76] Inventors: Leonid Sitko, 41 Chkalova 10-86, Marina Gorka, Minsk ob1, Belarus, 222810; Sergei Mitskevitch, 1691 Norwick New London Trpke, Uneasville, Conn. 06382

[21] Appl. No.: 09/006,893

[22] Filed: Jan. 14, 1998

[51] Int. Cl.[7] ..... F24C 9/00; F24D 3/00; E02B 41/00; B01F 13/00

[52] U.S. Cl. ..... 126/247; 237/1 R; 237/8 C; 122/26; 366/165.1; 366/338

[58] Field of Search ..... 126/247; 237/1 R, 237/8 C; 122/26; 366/165.1, 338, 339, 177.1

[56] References Cited

U.S. PATENT DOCUMENTS 3,989,189 11/1976 Kita ..... 126/247 X
4,781,172 11/1988 Byrd et al. ..... 126/378
5,392,737 2/1995 Newman, Sr. et al. ..... 126/247 X
5,566,476 10/1996 Hofbauer ..... 34/79
5,683,031 11/1997 Sanger ..... 126/247 X

*Primary Examiner*—Ira S. Lazarus
*Assistant Examiner*—David Lee
*Attorney, Agent, or Firm*—L. Zborovsky

[57] ABSTRACT

A liquid heating device, comprising a pump for pumping a liquid, a convertor for converting of a flow of the liquid, heat exchange a unit, the convertor being formed as a cyclone connected with the pump and having a main spiral passage for a tangential supply of the liquid, passage a unit from withdrawal of the liquid, and an additional spiral passage which is directed toward a side which is opposite toward the main passage is directed, the spiral passages having outlets which are offset relative to one another along an axis of the cyclone.

3 Claims, 2 Drawing Sheets

LIQUID HEATING DEVICE

BACKGROUND OF THE INVENTION

The present invention relates generally to generation of heat, and can be used for producing heat energy in industry, agriculture, private sector, etc.

Devices of the above mentioned general type are known in the art. One of such devices is disclosed for example in the Inventor's Certificate of the Soviet Union No. 1,703,924. In this device, heating is performed because of loss of hydraulic energy for whirl formation and friction in a flow of recirculating liquid. Mechanical energy due to the rotation of a working wheel of a blower is converted initially into a hydraulic energy and then into a thermal energy. This device however has a disadvantage that there is no braking element which allows sufficient withdrawal of the thermal energy.

Another device is disclosed in patent of Belarus No. 682, in which the efficiency is increased because a liquid is introduced into a closed loop of an accelerator in the form of a cyclone connected with a pump by an injection pipe, with a device for braking of liquid at the outlet of the cyclone. This device however has a disadvantage that in order to provide sufficient braking of liquid, the braking element must be exactly designed for a predetermined pump type and its hydraulic characteristics.

SUMMARY OF THE INVENTION

Accordingly, it is an object of the present invention to provide a liquid heating device which avoids the disadvantages of the prior art.

In keeping with these objects and with others which will become apparent hereinafter, one feature of present invention resides, briefly stated, in a liquid heating device which includes pipes and a closed loop of a pump connected with one another, a liquid flow convertor and heat exchangers, with the flow convertor formed as a cyclone connected with the pump by an injection pipe with a spiral passage for a tangential liquid supply and two axial passages for its withdrawal connected with a pipe, wherein in accordance with the present invention, a cyclone is additionally provided with a spiral passage directed toward a side opposite to the main spiral passage, and outlet windows for liquid withdrawal are formed symmetrical relative to the axis of the injection pipe.

In accordance with a further feature of the present invention, a partition with a screw surface is arranged at an outlet of a common pipe, and the direction of the screw line coincides with a direction of rotation of the pump.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
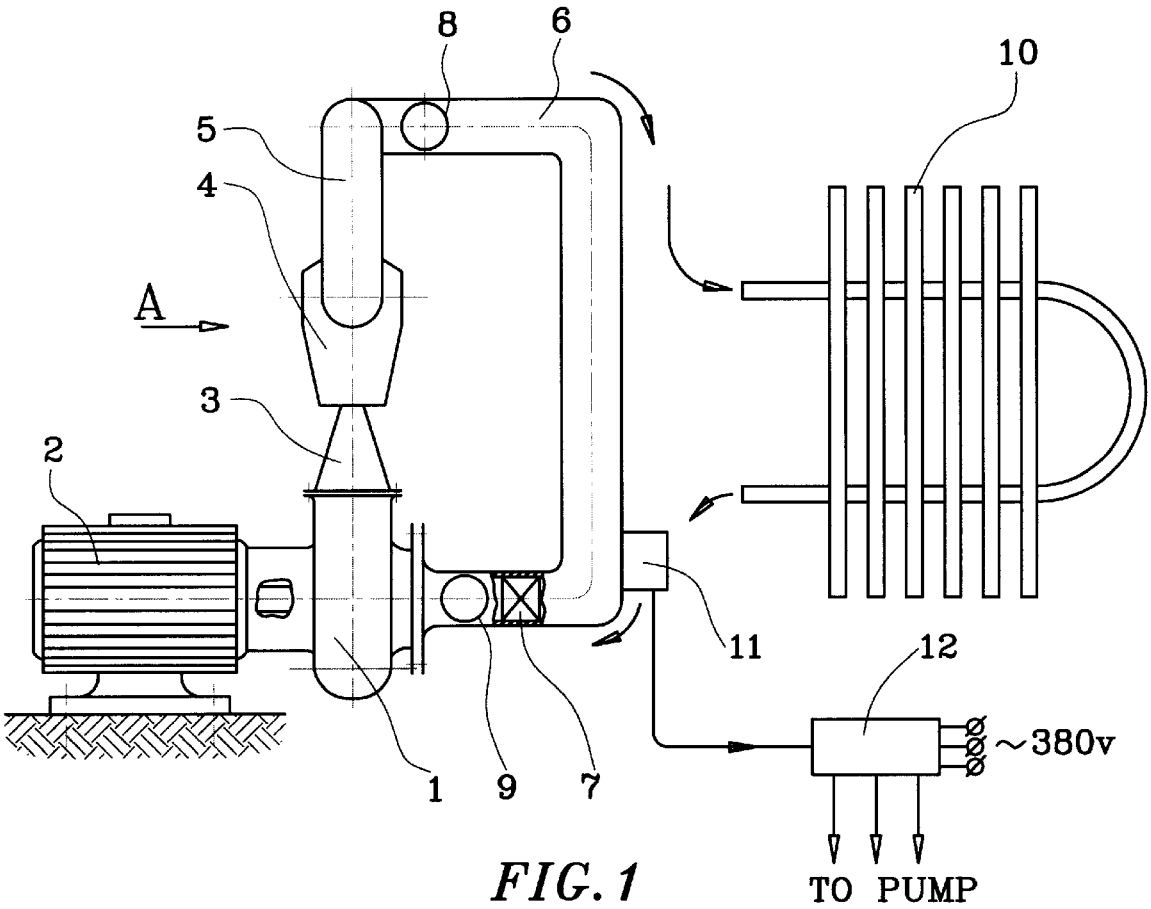
FIG. 1 is a view of liquid heating device in accordance with present invention.
Figure 2:
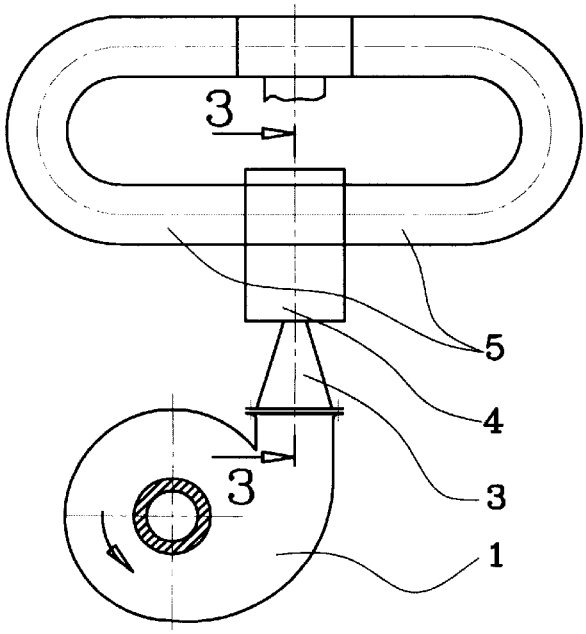
FIG. 2 is a view as seen in direction of the arrow 8 in FIG. 1.
Figure 3:
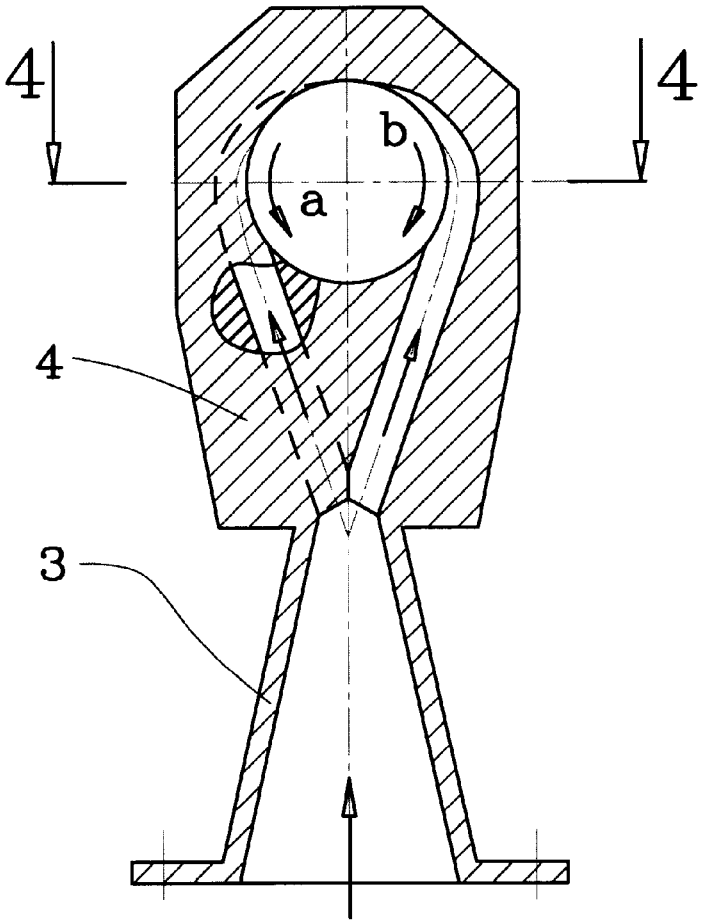
FIG. 3 is a view showing a section taken along the line III—III in FIG. 2.

A liquid heating device in accordance with present invention has a pump which is identified with reference numeral 1 and is driven by an electric motor 2. The pump 1 is connected by an injection pipe 3 with a cyclone 4. Two outlets of the cyclone 4 are connected with an inlet of a common pipe line 6 by two pipes 5 which are symmetrical relative to one another.

The common pipe line 6 is provided with a partition at its outlet. The partition 7 has a screw surface. The device further has a pipe for withdrawal of a heat carrier 8 and the pipe for return of the heat carrier 9. The pipes 8 and 9 are connected by further pipes with a heating heat exchangers or convectors 10.

In order to operate the device in an automatic mode, a temperature sensor 11 is connected to the common pipeline 6. The temperature sensor is connected in turn with an electronic device 12 for maintaining temperature within a given interval.

The liquid heating device in accordance with the present invention operates in the following manner.

Figure 4:
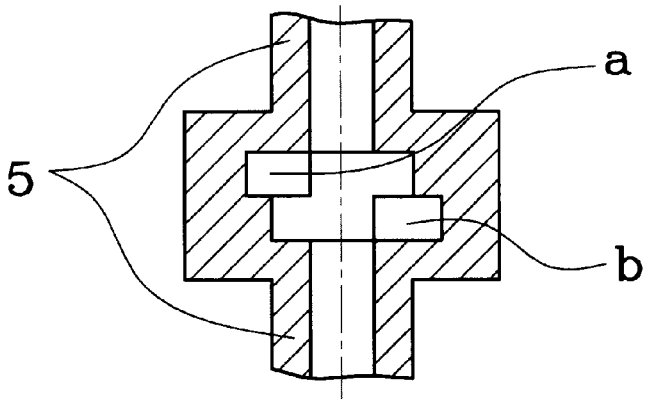
FIG. 4 is a view showing a cross-section taken along the line IV—IV in FIG. 3.

A liquid which is a heat carrier is pumped by the pump 1 which is rotated by the electric motor 2, through the injection pipe 3 into the cyclone 4. The cyclone has a cavity formed by two geometrically identical and independent spiral passages, including a main passage A and an additional passage B shown in FIG. 4. One of the passages, for example the passage A is twisted counterclockwise, while the other passage for example the passage B is twisted clockwise.

The flow of heat carrier which is pumped by the pump and exits the injection pipe 3 is separated in the cyclone 4 into two flows which have identical volumes. Due to the different directions of the passages A and B, the flows are twisted in two opposite directions. Both flows obtain the same energy.

Initially the heat release starts along the surface of contact between two flows inside the cyclone 4. As a result, two flows which have equal volumes and rotate in two opposite directions exit the cyclone 4. The common pipeline 6 again unites both flows into a single flow. Since the flows meet one another with a rotation in a counter phase at this moment an efficient mutual braking of the flows with the emission of a main heat occurs. The common pipe line 6 cross feeds the flow of the heat exchanger, and the temperature of the latter increases during pumping from one cycle to the other.

The partition 7 having a screw surface and arranged at the input of the pump 1 in the common pipeline 6 has such a surface whose direction coincides with the direction of rotation of the pipe 1. Thereby the conditions of introduction of the heat carrier flow into the pump 1 are improved, the energy consumption for pumping the heat carrier is reduced. Also cavitational phenomenal which negatively affects the operation of the pump 1 and destroys the pump are reduced.

The heat withdrawal in heating heat exchangers or convectors 10 shown in FIG. 1 is carried out through the pipe 8 for withdrawal of the heat carrier. After the heat exchangers 10 give out the heat, the heat carrier is again returned into the liquid heating device through the pipe 9 for heat carrier return.

The heat carrier can be represented by water or other liquids with acceptable thermo characteristics. The pump can be driven from electrical or thermal engine, from hydraulic engine, or from wind engine.

The automatic control of the working temperature is performed by means of the temperature sensor 11, which is formed for example as a thermo resistor. The maintenance of temperature within a necessary interval is performed by the electronic device 12. The electronic device 12 turns off the pump 1 when a given upper temperature is reached, and turns on the pump 1 when the temperature drops to below the given lower level.

The liquid heating device in accordance with the present invention is a high efficiency ecologically pure heat thermal source.

It will be understood that each of the elements described above, or two or more together, may also find a useful application in other types of constructions differing from the types described above.

While the invention has been illustrated and described as embodied in liquid heating device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

The claims which define the subject matter of the liquid heating device in accordance with the present invention are presented hereinbelow.

What is claimed is:

1. A liquid heating device, comprising a pump for pumping a liquid; a convertor for converting a flow of the liquid, said converter being formed as a cyclone connected with said pump and having two passages in which the flow of liquid is subdivided into two flows; and a common pipe connected with said two passages for uniting the two flows of liquid, said pipe having an outlet provided with a partition with a screw-shaped surface, said pump being rotatable in a predetermined direction, said screw-shaped surface being formed by a screw line which coincides with the direction of rotation of said pump.

2. A liquid heating device, comprising a pump for pumping a liquid; a convertor for converting a flow of the liquid and formed as a cyclone connected with said pump, said convertor being provided with two spiral passages in which the flow of liquid is subdivided into two flows, said passages being twisted in opposite directions so that the two flows of liquid are also rotated in two opposite directions; and a common pipeline connected to outlets of said two passages so that the two flows of liquid rotated in two opposite directions are being united in said common pipeline in a counter phase with emission of heat.

3. A liquid heating device as defined in claim 1, wherein said cyclone has an injection pipe connected with said pump, said passages being arranged symmetrically to an axis of said injection pipe.

* * * * *